US007523902B2

(12) United States Patent
Almeida

(10) Patent No.: US 7,523,902 B2
(45) Date of Patent: Apr. 28, 2009

(54) DEVICE FOR SECURING ITEMS IN A DISHWASHER

(76) Inventor: Mary Ellen Almeida, 13 Cypress La., Briarcliff, NY (US) 10510-1215

( * ) Notice: Subject to any disclaimer, the term of this patent is extended or adjusted under 35 U.S.C. 154(b) by 484 days.

(21) Appl. No.: 10/981,924

(22) Filed: Nov. 5, 2004

(65) Prior Publication Data

US 2006/0097118 A1 May 11, 2006

(51) Int. Cl.
*A47B 96/06* (2006.01)

(52) U.S. Cl. ..... 248/229.13; 248/229.26; 211/41.9

(58) Field of Classification Search ..... 248/229.13, 248/229.23, 229.1, 229.2, 229.26, 229.16; 211/41.9
See application file for complete search history.

(56) References Cited

U.S. PATENT DOCUMENTS

| | | | | |
|---|---|---|---|---|
| 5,038,430 | A * | 8/1991 | Bly | 5/425 |
| 5,038,799 | A * | 8/1991 | Fowler et al. | 128/878 |
| 5,709,685 | A * | 1/1998 | Dombrowski et al. | 606/61 |
| 5,918,749 | A * | 7/1999 | Pille et al. | 211/41.9 |
| 6,244,557 | B1 * | 6/2001 | Maze | 248/541 |
| 6,386,786 | B1 * | 5/2002 | Perlman et al. | 403/90 |
| 6,394,285 | B1 * | 5/2002 | Arthurs et al. | 211/41.9 |
| 6,827,225 | B2 * | 12/2004 | Miilu et al. | 211/41.9 |

* cited by examiner

*Primary Examiner*—Korie Chan
*Assistant Examiner*—Steven Marsh
(74) *Attorney, Agent, or Firm*—Collen IP; Donald J. Ranft

(57) ABSTRACT

A method and apparatus for securely holding and maintaining space between items to be washed in a dishwasher. The novel apparatus consists of a rigid member with a means for gripping an item for washing at each end of the rigid member.

4 Claims, 4 Drawing Sheets

DEVICE FOR SECURING ITEMS IN A DISHWASHER

BACKGROUND OF INVENTION

Dishwashers are designed to wash as many different sizes and shapes of food preparation, serving and storage devices as possible. To allow for thorough cleaning, dishwashers attempt to provide structural means to space the dirty item to allow high-pressure water containing a washing medium to directly contact the dirty item. It is an objective of dishwasher designs to also keep the dirty item upright during the entire wash, rinse and dry cycles to ensure dirty water is not collected. The designs of dishwashers further tend to prevent items to be washed from banging against each other. However this last feature is not a primary criteria in dishwasher design partly because minor touching of other items during washing is typically not a problem.

Some items such as glassware and dishes with trim on its edges are damaged by banging during dishwasher high-pressure-water cycles.

U.S. Pat. No. 6,394,285 (Arthurs) discloses a means to specifically secure stemware in a dishwasher. It does so by attaching one end of its device to the typical wire stringers in dishwashers and the other end allows acceptance of a stem of 3 different diameters. Arthurs does a good job of describing a number of patents designed to restrain movement by stemware.

Additional patents address means to securely hold and space objects such as stemware. U.S. Pat. Nos. 6,244,554 and D419,402 (Baker) provide a means to secure stemware (2) to the neck of a bottle. U.S. Pat. No. 3,624,673 (Merchant) discloses a device which is described as a double ended clothes pin.

None of the prior art discloses a means to hold and secure the item at a designated space between them during dishwashing cycles.

SUMMARY OF INVENTION

An object of this invention is to provide a means to space and securely hold items placed in a dishwasher. Another objective is to provide a means to easily attach to multiple items such as stemware and dishes of multiple sizes and shapes. Another objective is to provide a means to adjust the space between the items as warranted by the size and shape of the items and the internal arrangement required by a particular dishwasher.

Briefly the invention includes a method and a device to securely attach to two items in a dishwasher with a rigid material in between to the two attachment devices at its ends.

DETAILED DESCRIPTION OF PREFERRED EMBODIMENT

Figure 1:
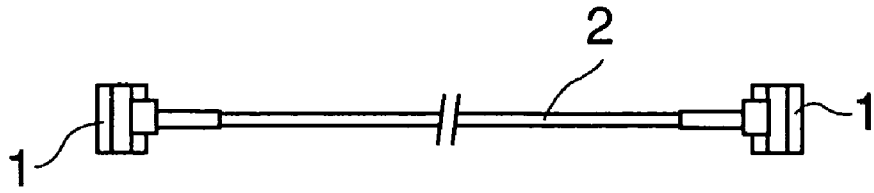
FIG. 1 depicts a front view of a dishwasher spacing device with an attachment device at each end.

A front view of the present invention is shown in FIG. 1. The spacing device is designed to securely attach to a wine glass at each end utilizing an attachment means. The device is composed of a material which is capable of withstanding its integrity through the typical temperature ranges and detergents it will be subjected to a typical material to be used would be resin based. One possible attachment means is the attachment device (1) depicted in FIG. 1. The attachment device (1) are held at a specified distance by a rigid member (2). The length of the rigid member (2) will vary to accommodate the different desired spacing between the items to be washed.

Figure 2:
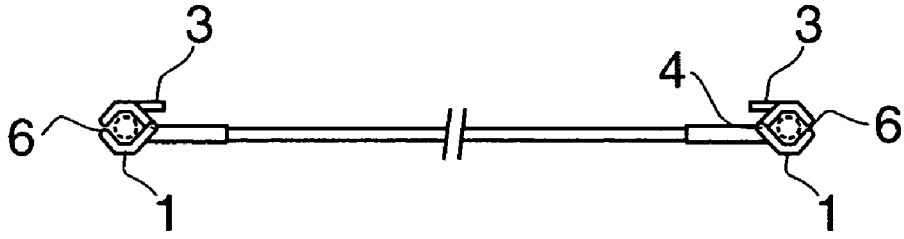
FIG. 2 depicts a top view of a dishwasher spacing device with an attachment device at each end.

FIG. 2 depicts a top view of the preferred embodiment for this invention. The attachment device (1) is designed to surround and capture an item to be restrained. This is accomplished by having the hexangular body be slightly open at one location (6). By pressing on an integral tab (3) extending from the hexangular body of the attachment device, (1) the opening is extended. This allows the insertion of the item to be restrained. Pressing the tab rotates 3 sides of that hexangular attachment device (1) around a pivot point 4.

Figure 3:
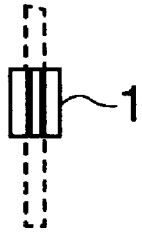
FIG. 3 depicts an attachment device with stem insert.

FIG. 3 shows one attachment device (1) with a wine glass stem captured.

Figure 4:
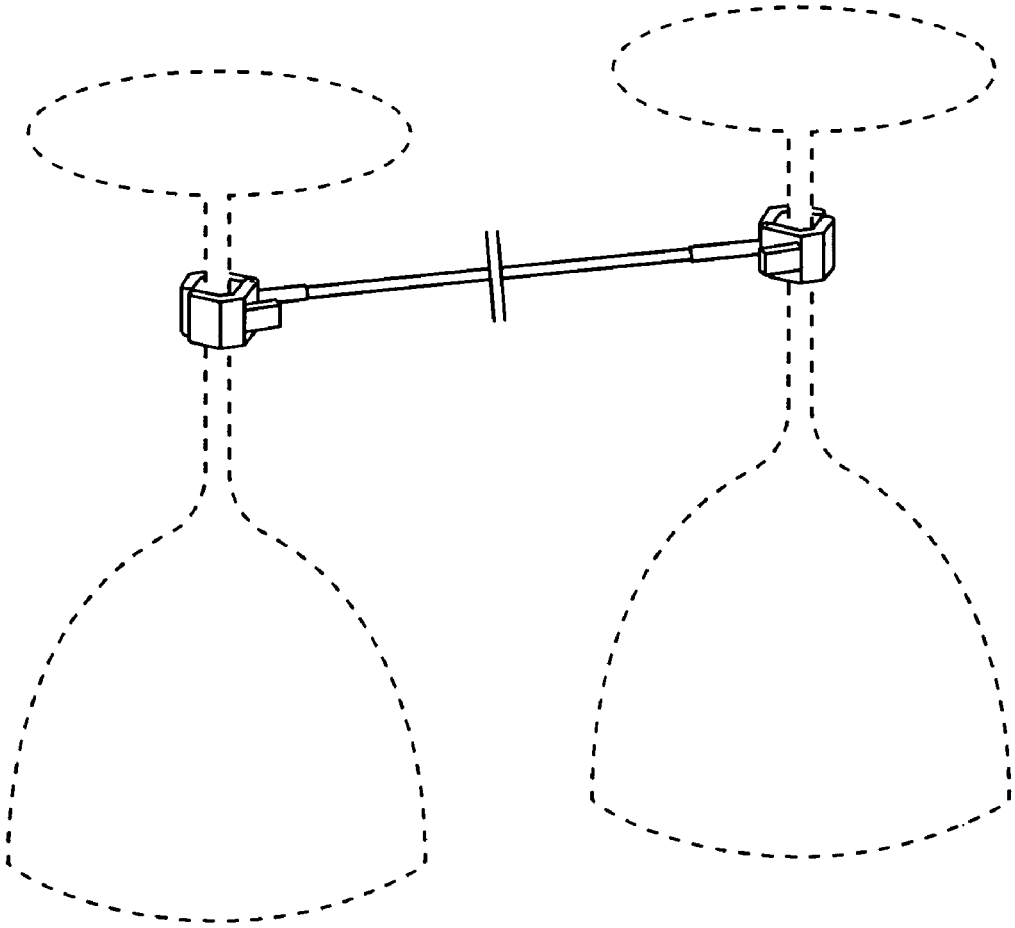
FIG. 4 depicts a dishwasher spacing device securely attached to a wine glass at each end.
Figure 5:
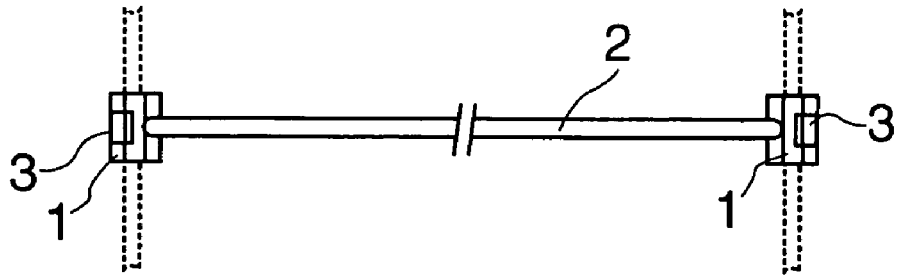
FIG. 5 depicts a front view of a second embodiment of a dishwasher spacing device with an attachment at each end.
Figure 6:
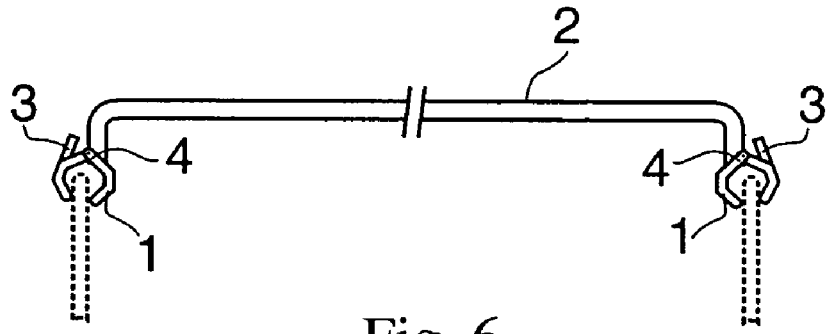
FIG. 6 depicts a top view of a second embodiment view of a second embodiment of a dishwasher spacing device with an attachment at each end.
Figure 7:
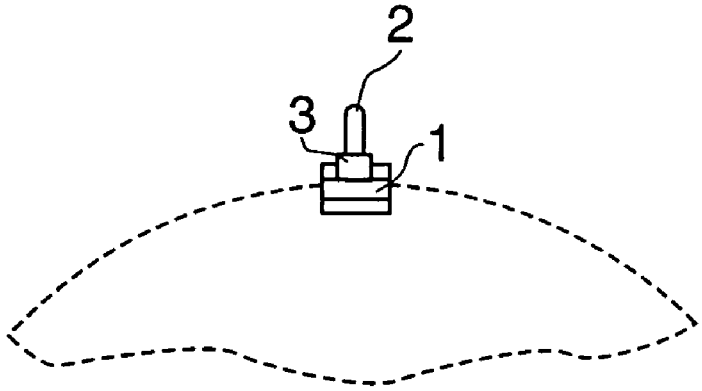
FIG. 7 depicts a second embodiment of an attachment device with a dish inserted.
Figure 8:
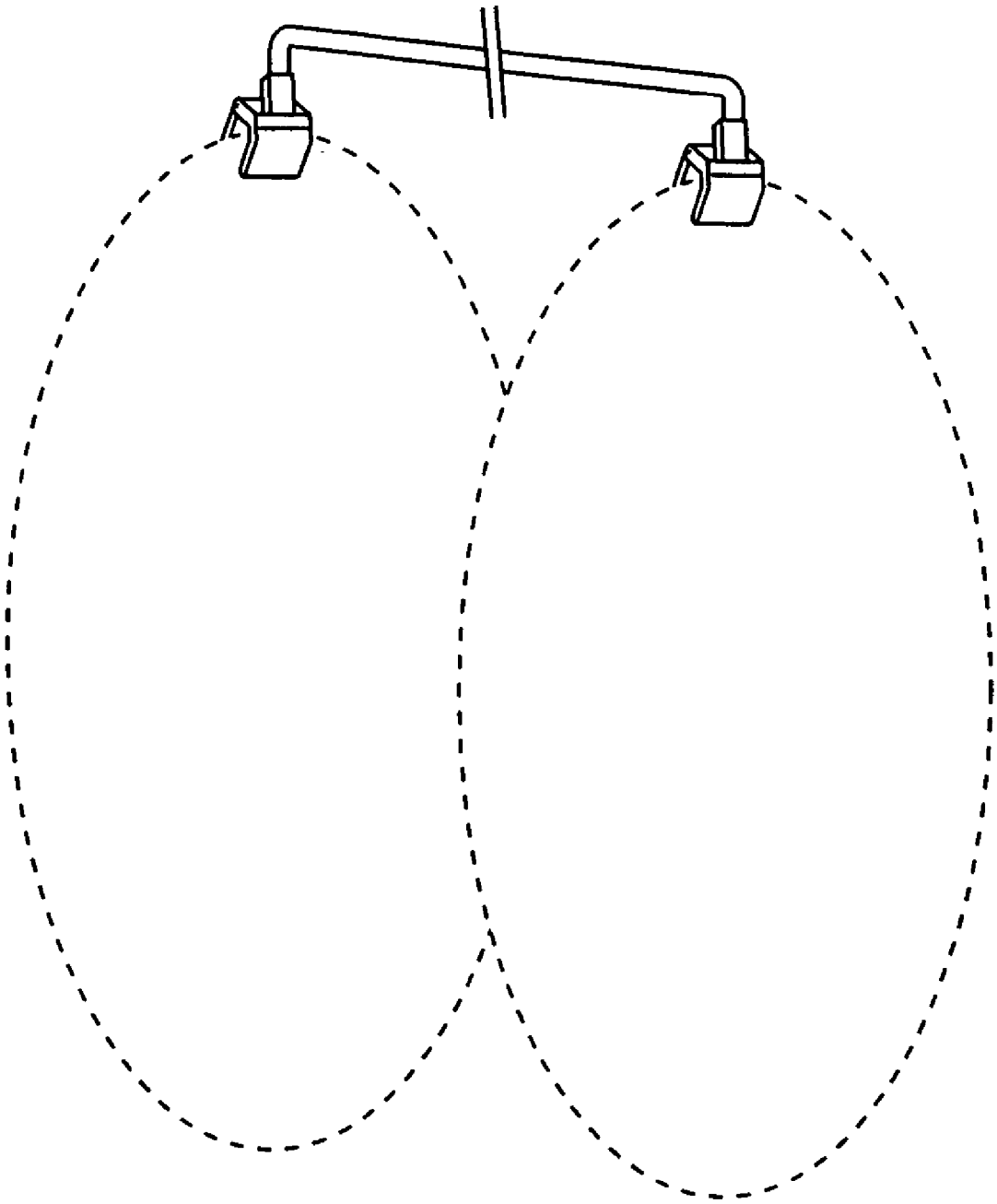
FIG. 8 depicts a second embodiment of a dishwasher spacing device securely attached to a dish at each end.

FIG. 4 shows the spacing device as it would be installed in a dishwasher to maintain spacing between typical wine glasses.

This attachment device can be used to capture any items placed in a dishwasher by varying the size of the attachment devices (1), the orientation of the open side of the attachment device; and the length of the rigid member (2).

FIGS. 5-8 show a second embodiment of a spacing device designed to securely space dishes. To accomplish this, the open side of the attachment device is typically oriented to open at 90° from the axis of the rigid member (2). In addition other embodiments of this invention utilize attachment devices (1) of different configurations such as the variety of clipping devices which are readily available.

The description above and accompanying figures are presented as examples of the present invention. The scope of the present invention is not limited by the exemplary embodiments. Other applications and variations of the present invention are possible to meet a particular application. For example, the attachment device may be attached to the rigid member via a pivoting means to allow different angles.

The above is a detailed description of particular embodiments of the invention. It is recognized that departures from the disclosed embodiments may be made within the scope of the invention and that obvious modifications will occur to a person skilled in the art. Those of skill in the art should, in light of the present disclosure, appreciate that many changes can be made in the specific embodiments which are disclosed herein and still obtain a like or similar result without departing from the spirit and scope of the invention. All of the embodiments disclosed and claimed herein can be made and executed without undue experimentation in light of the present disclosure.

I claim:

1. A dishwasher apparatus for securely holding and maintaining a space between dirty dishes comprising:

a dishwasher;

dishes to be cleaned in the dishwasher;

an attachment device designed to grip the dishes wherein the attachment device is a hexangular body with an opening between 2 of the six sides and a second opening at the center of the hexangular body;

a rigid rod member with one attachment device at each of its ends; and further comprising a means to open and close the opening between 2 of the sides of the hexangular body in each of the attachment devices to allow insertion of the dirty dishes for washing.

2. A dishwasher apparatus for securely holding and maintaining a space between dirty glassware comprising:

a dishwasher;

dishes to be cleaned in the dishwasher;

an attachment device designed to grip the dishes wherein the attachment device is a hexangular body with an opening between 2 of the six sides and a second opening at the center of the hexangular body;

a rigid rod member with one attachment device at each of its ends wherein the device with rod and two attachment devices is smaller than the dishes to be gripped; and further comprising a means to open and close the opening between 2 of the sides of the hexangular body in each of the attachment devices to allow insertion of the dirty dishes for washing.

3. An apparatus according to claim 1 in which the attachment device is mounted to the rigid member in such a manner which allows the opening to be oriented at different angles from the rigid member.

4. An apparatus according to claim 2 in which the attachment device is mounted to the rigid member in such a manner which allows the opening to be oriented at different angles from the rigid member.

* * * * *